US008018159B2

(12) United States Patent
Fuks et al.

(10) Patent No.: US 8,018,159 B2
(45) Date of Patent: Sep. 13, 2011

(54) MAGNETRON DEVICE WITH MODE CONVERTER AND RELATED METHODS

(75) Inventors: Mikhail I. Fuks, Albuquerque, NM (US); Edl Schamiloglu, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 532 days.

(21) Appl. No.: 12/154,658

(22) Filed: May 23, 2008

(65) Prior Publication Data

US 2009/0058301 A1 Mar. 5, 2009

Related U.S. Application Data

(60) Provisional application No. 60/931,719, filed on May 25, 2007.

(51) Int. Cl.
*H01J 25/50* (2006.01)

(52) U.S. Cl. ..... 315/39.51; 315/34; 315/39

(58) Field of Classification Search ..... 315/39.51, 315/34, 39.71, 39.75, 39.77, 39
See application file for complete search history.

(56) References Cited

U.S. PATENT DOCUMENTS

| | | | | |
|---|---|---|---|---|
| 3,312,859 | A * | 4/1967 | Wilbur et al. | 315/39 |
| 4,200,821 | A * | 4/1980 | Bekefi et al. | 315/39.51 |
| 5,159,241 | A * | 10/1992 | Kato et al. | 315/39.51 |
| 5,162,698 | A | 11/1992 | Kato et al. | |
| 5,552,672 | A * | 9/1996 | Rosenberg | 315/39.51 |
| 7,106,004 | B1 * | 9/2006 | Greenwood | 315/39.51 |
| 7,148,627 | B2 | 12/2006 | Ishii et al. | |
| 7,163,655 | B2 | 1/2007 | Weber et al. | |
| 7,245,082 | B1 * | 7/2007 | Fleming | 315/39.67 |
| 7,265,360 | B2 * | 9/2007 | Baker et al. | 250/393 |
| 7,696,696 | B2 * | 4/2010 | Fuks et al. | 315/39.51 |
| 2005/0011455 | A1 | 1/2005 | Yamamoto et al. | |

OTHER PUBLICATIONS

M. Daimon, K. Itoh, G. Imada, and W. Jiang, "Experimental demonstration of relativistic magnetron with modified output configuration", App. Phys. Letters, 92 (2008).

M. Daimon ,and W. Jiang, "Modified configuration of relativistic magnetron with diffraction output for efficiency improvement," App. Phys. Letters, 91 (2007).

* cited by examiner

*Primary Examiner* — Thuy Vinh Tran
(74) *Attorney, Agent, or Firm* — Valauskas Corder LLC

(57) ABSTRACT

The present invention provides a relativistic magnetron with axial extraction, or magnetron with diffraction output (MDO), with a mode converter placed directly within the diffraction output of radiation to effectively convert the operating π-mode into a radiated mode of simpler radiation patterns.

8 Claims, 9 Drawing Sheets

MAGNETRON DEVICE WITH MODE CONVERTER AND RELATED METHODS

This application claims the benefit of U.S. Provisional Application No. 60/931,719 filed May 25, 2007.

FEDERALLY SPONSORED RESEARCH

The present invention was made with government support under Grant No. N00014-06-1-0476 awarded by the Office of Naval Research. As a result, the Government has certain rights in this invention.

FIELD OF THE INVENTION

The present invention relates to magnetrons, and more specifically to a relativistic magnetron with axial extraction of electromagnetic energy, otherwise known as a magnetron with diffraction output (MDO).

BACKGROUND OF THE INVENTION

Magnetrons are compact narrowband high power microwave sources primarily used to generate power at microwave frequencies. Magnetrons are used in applications, for example, radar systems, microwave oven devices, plasma screen apparatuses, plasma lighting, manufacturing such as medical device manufacturing, and linear accelerator applications to name a few.

One of the first magnetrons was the two-pole magnetron, also known as a split-anode magnetron. A major problem with the two-pole magnetron was low efficiency. As a result, the cavity magnetron was developed, which proved to be far more useful.

The basic construction of a cavity magnetron includes a cathode, anode, antenna, cavities and waveguide. The cathode is centrally located in a chamber. The anode surrounds the cathode and includes vanes that form cavities at a fixed radius from the cathode. The entire assembly is placed in a powerful magnetic field. The magnetic field is parallel to the axis of the cathode and is imposed by a permanent magnet or pair of Helmholtz coils. The magnetic field causes electrons emitted from the cathode to spiral outward in a circular path rather than moving directly to the anode. As the electrons sweep past the cavities, they induce a resonant, high-frequency radio field within the cavities. A portion of this field is extracted with a short antenna that is coupled to a waveguide. The antenna is a probe or loop that is connected to the anode and extends into the cavities. The antenna transmits the extracted high-frequency radio field, or RF energy, into the waveguide. The waveguide then directs the RF energy to the load. The load, for example, may be a cooking chamber in a microwave oven or a high-gain antenna in a radar system.

Different types of extraction of the radio field can be applied, such as radial extraction and axial extraction. The size of the cavities determine the resonant, high-frequency radio field, and thereby the frequency of emitted microwaves known as the radiation pattern.

The most compact narrowband high power microwave source is known as a relativistic magnetron with axial extraction of electromagnetic energy, also known as the magnetron with diffraction output (MDO). Its advantages compared to conventional magnetrons are its compactness, improved resistance to microwave breakdown, and the ability to use any mode as the operating mode. In addition, possible mode hopping is not dangerous. However, the radiation pattern of a MDO is more complicated than that of the conventional magnetron that can make it difficult for some applications. What is needed is a relativistic magnetron that creates simpler radiation patterns. The present invention satisfies this need.

SUMMARY OF THE INVENTION

The present invention is an improved relativistic magnetron with axial extraction of electromagnetic energy, or magnetron with diffraction output (MDO), that forms simple radiation patterns.

The MDO is a compact and effective narrowband high power microwave source. For example, an X-band MDO achieves a radiation power of about 0.5 GW for an applied voltage of 0.5 MW and 4.0 GW for an applied voltage of 1.0 MV, wherein the radiation pulse duration in each case is about 10 ns, with a beam-to-microwave conversion efficiency of about 12%.

As shown in FIG. 1, the MDO is based on a conventional magnetron resonant system and includes a cathode 15 and resonant system 20. Resonant system 20 includes cavities that extend in the axial direction and are flush with a conical horn antenna 25 up to a radius that exceeds the radius corresponding to the cutoff frequency of the radiated wave in a regular cylindrical waveguide. FIG. 1 shows some examples of such diffraction output. The symmetrical design of the MDO with axial extraction allows the use of a truly compact magnetic field-producing system in the form of a single short solenoid 30 whose diameter is determined by the outer diameter of the resonant system 20. The coaxial line for magnetron feeding is shown by 35.

The resistance of the MDO to microwave breakdown is far better by many orders than that of the conventional magnetron. Therefore, the diffraction output 25 can be used in relativistic magnetrons with very high radiated powers.

In conventional magnetrons the axial length L of the cavities is typically about half of the operating wavelength $\lambda$ in order to avoid competition between longitudinal modes. In the MDO, however, the limitation on the axial length is softer. The quality factor Q of the MDO is close to the minimum diffraction quality factor ($Q_{diff}$):

$$Q \approx Q_{diff} = \frac{8\pi}{n}\left(\frac{L}{\lambda}\right)^2 \tag{1}$$

Here n is the number of axial variations of the microwave electric field. As it is shown from Equation (1), the quality factor Q is largest for the lowest longitudinal mode (with n=1) for any length L of the cavities. Therefore, the selection of longitudinal modes is automatically achieved, giving the possibility of increasing the radiation power P without increasing the applied voltage U, but rather by increasing the anode current $I_a$, which is proportional to L.

The limitation of the axial length L in the MDO is associated with decreasing the axial current $I_z$ along the cathode as electrons are deposited onto the anode. This changes the magnetic field $H_0=\sqrt{H_{0z}^2+H_{0\theta}^2}$ that is tangential to the cathode surface, which can disrupt the synchronism condition for single mode generation, that is, the proximity of the average azimuthal electron velocity $v_e=cE_0H_{0z}H_{0z}/H_0^2$ to the phase velocity $v_{ph}$ of the operating wave:

$$v_e \approx v_{ph} \tag{2}$$

Here $E_0$ is the radial electric field that is determined by the applied voltage U in the gap $d=R_a-R_c$ between the electrodes (where $R_a$ and $R_c$ are the anode and cathode radii, respectively). $H_{0z}$, is the applied axial magnetic field and $H_{0\theta}=2I_z/cr$ for $r \geqq R_c$, wherein c is the speed of light. The field $H_{0\theta}$decreases along a magnetron as electrons deposit on the anode; therefore, the electron velocity $v_e$ depends on the longitudinal coordinate, and its change must be less than the difference $\Delta v_{ph}$ between phase velocities of neighbor modes in order to provide the condition in Equation (2). The single mode regime is wittingly provided, when $$\Delta v_{ph}/v_{ph} > (H_\theta/H_z)^2 \quad (3)$$

Since the leakage current is much less than the anode current, the axial cathode current $I_z \approx I_a$ is proportional the length L of the interaction space. Thus, the inequality of Equation (3) is, in essence, the condition that limits the length L in the MDO, which can be sufficiently longer than in conventional magnetrons.

Further increasing the radiated power of magnetrons requires increasing the number of cavities N, which in turn increases the probability of hopping from the operating mode to a neighboring one.

As a rule, the π-mode and the 2π-mode are used in magnetrons as the operating modes, and only these modes are non-degenerate, whereas all other modes are azimuthally degenerate. The asymmetric output of the conventional magnetron removes the degenerate nature of the modes, fixing the nodes and antinodes of electric fields of the degenerate modes by splitting each such mode into two submodes—one with a sinusoidal distribution and one with a co-sinusoidal azimuthal distribution with respect to the output waveguide. The submode with the fixed antinode near the cavity coupled with the output waveguide is radiated, unlike the submode with the node near the cavity. Therefore, the first submode has a lower Q than the unloaded submode. In the case of mode hopping from the π or 2π operating mode to a neighboring degenerate mode, the submode with the higher Q, that is, the non-radiated submode, is the most probable new operating mode because of its lower start conditions. Thus, the magnetron will operate in a manner scattering its microwave energy onto the electrodes, which can lead to serious disruption particularly if the magnetron operates at a high repetition rate.

The diffraction output of the magnetron does not remove the degeneracy because all of the cavities are identically loaded. Therefore, any mode can be selected in the MDO as the operating mode, and possible mode hopping is not dangerous.

It should be noted that, in parallel with the above-enumerated advantages of the MDO, its radiation pattern is more complicated (the $TE_{N/2,1}$ mode is radiated when the lo magnetron operates in the π-mode) than that of the conventional magnetron, in which the lowest $TE_{10}$-mode of the output rectangular waveguide is radiated.

The present invention provides a relativistic magnetron with axial extraction that has the ability to form simple radiation patterns including a narrow wave beam close to a Gaussian radiation pattern. The mode converter is integrated directly within the diffraction output of radiation to effectively convert the operating π-mode into a radiated mode of simpler radiation patterns.

An object of the present invention is to provide an improved magnetron device serving as a high power microwave source for both commercial and industrial purposes, for example, high resolution radars.

Another object of the present invention is to provide an improved magnetron device wherein mode conversions are achieved without increasing the dimensions of the diffraction output of radiation, such as the conical horn antenna.

Another object of the present invention is to provide an improved magnetron device with a mode converter that can operate across a wide band of frequencies.

The present invention and its attributes and advantages will be further understood and appreciated with reference to the detailed description below of presently contemplated embodiments, taken in conjunction with the accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF EMBODIMENTS OF THE INVENTION

Figure 1:
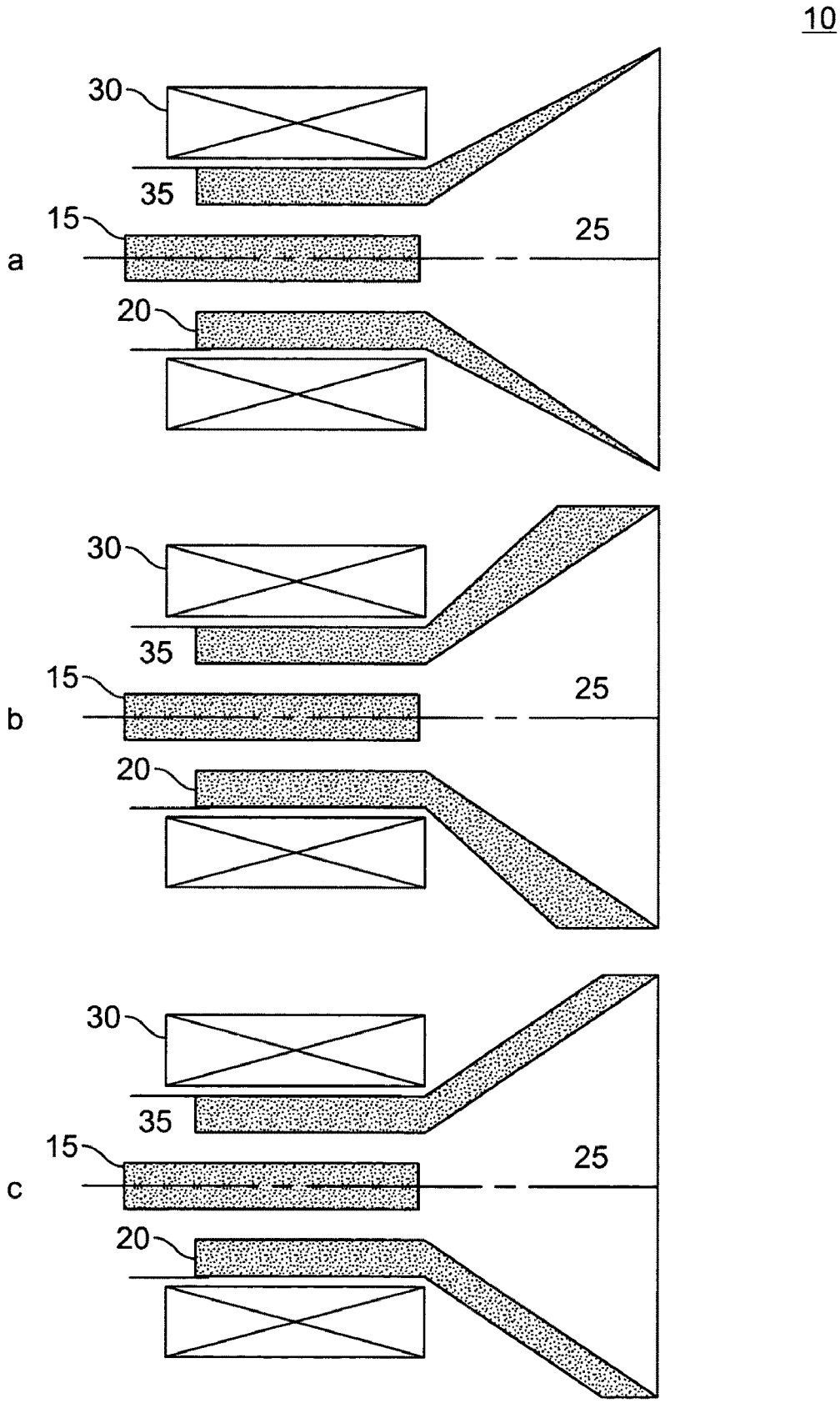
FIG. 1 illustrates some designs of a relativistic magnetron with axial extraction of electromagnetic energy, or magnetron with diffraction output (MDO)

The present invention provides a relativistic magnetron with axial extraction (see FIG. 1), or magnetron with diffraction output (MDO), that has the ability to form simple radiation patterns including a narrow wave beam close to a Gaussian radiation pattern. The mode converter is integrated directly within the diffraction output of radiation to effectively convert the operating π-mode into a radiated mode of simpler radiation patterns. The efficiency of mode conversion of the operating π-mode into a radiated mode is discussed herein using computer simulations of a 6-cavity magnetron. More specifically, only those cavities of the anode are extended onto an antenna that corresponds to the symmetry of the radiated modes.

Figure 4:
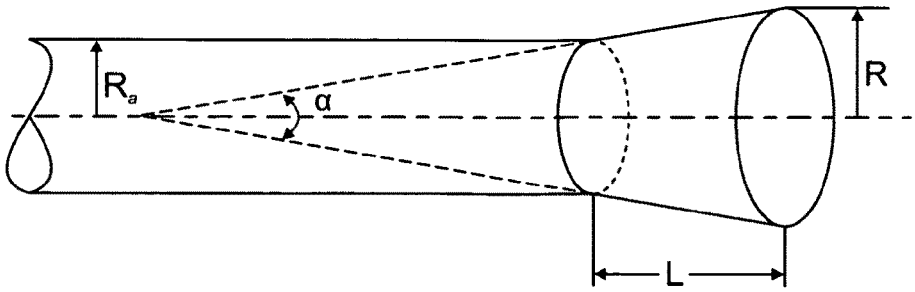
FIG. 4 illustrates a schematic drawing of a conical horn antenna according to the present invention.

To illustrate the concept of a mode converter within the MDO, the 6 cavities N=6 of the magnetron are joined with a conical horn antenna. FIG. 4 illustrates a schematic drawing of the conical horn antenna. In the converter, the symmetry of the electric fields in the resonant system of a magnetron operating in the π-mode is exploited when phases of electric fields in neighboring cavities are opposite as shown in FIG. 2A, FIG. 2B and FIG. 2C.

Figure 2A:
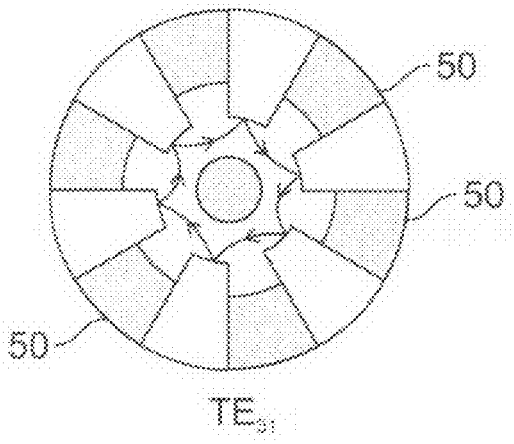
FIG. 2A illustrates the configurations of 6 cavities and their extension onto the horn antenna for conversion of the operating π-mode of the magnetron to the radiated $TE_{31}$ mode according to the present invention.

All cavities are extended onto the horn antenna as shown by 50 in FIG. 2A up to the diameter of the antenna, which exceeds the cutoff condition for a radiating mode. The radiation pattern corresponds to the $TE_{N/2,1}$ mode, that is, the $TE_{31}$ mode.

Figure 2B:
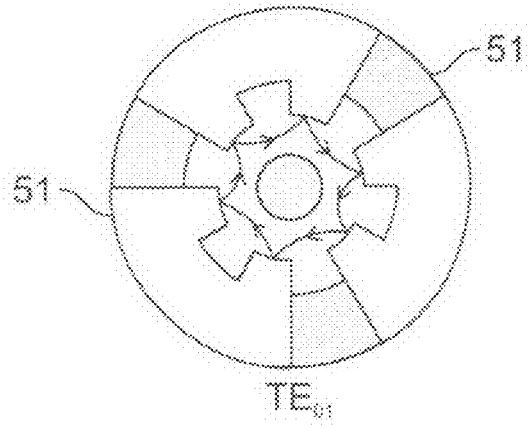
FIG. 2B illustrates the configurations of 6 cavities and their extension onto the horn antenna for conversion of the operating π-mode of the magnetron to the radiated $TE_{01}$ mode according to the present invention.
Figure 2C:
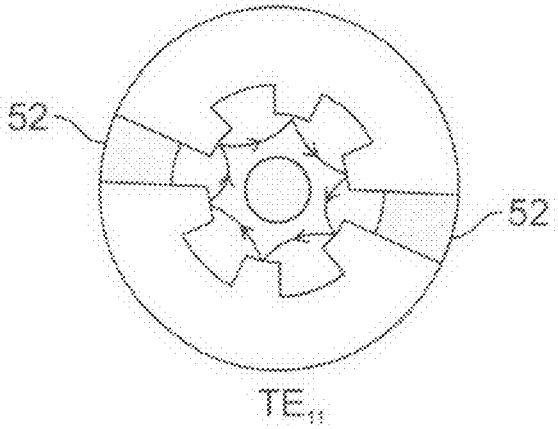
FIG. 2C illustrates the configurations of 6 cavities and their extension onto the horn antenna for conversion of the operating π-mode of the magnetron to the radiated $TE_{11}$ mode according to the present invention.

When only every other cavity is extended onto the horn antenna as shown by 51 in FIG. 2B in the same manner, the antenna is excited by electric fields with identical phases. For this symmetry of electric fields the radiation pattern corresponds to the $TE_{01}$ mode.

Figure 3:
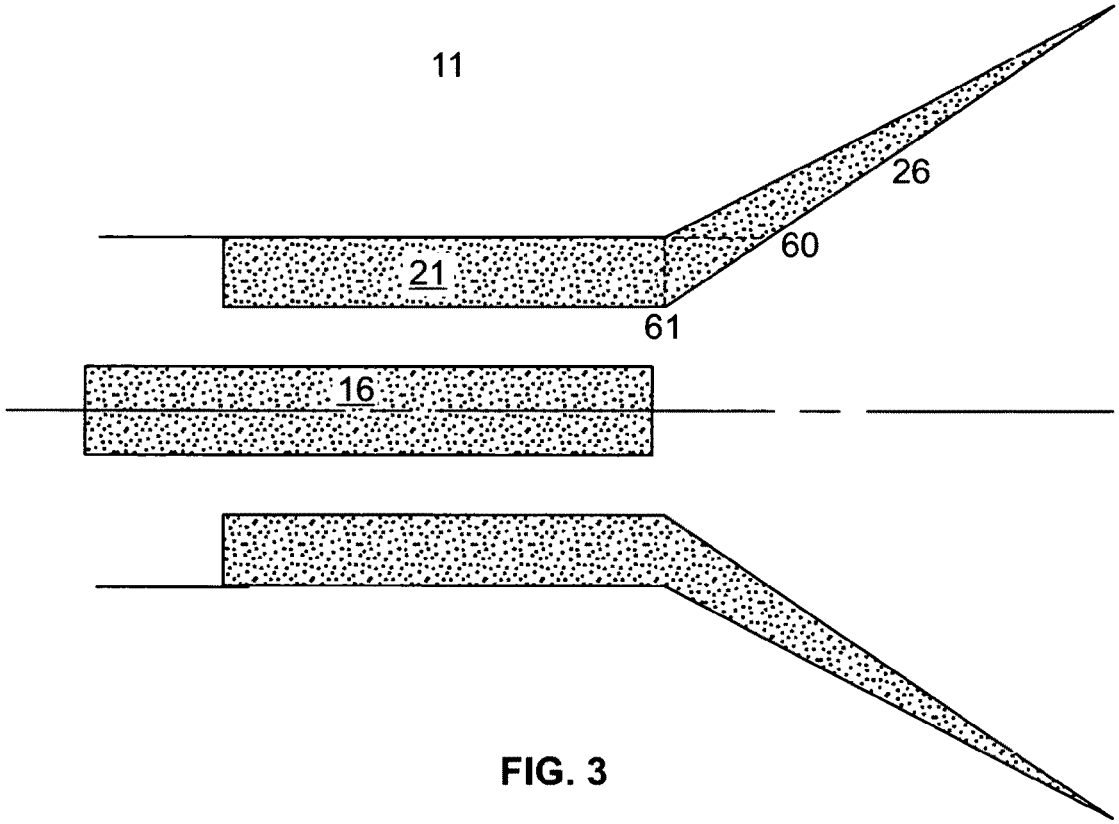
FIG. 3 illustrates a design diagram of a side view of a magnetron with diffraction output corresponding to the design in FIG. 1*a* according to the present invention.

As shown in FIG. 2B, the other cavities must not be coupled with the antenna, which can be achieved, for example, by extension of these cavities at their maximum radii onto the horn antenna as shown by the dotted line 60 in FIG. 3 or by closing them as shown by the line 61. As shown in FIG. 3, the MDO 11, which corresponds to the design in FIG. 1*a*, includes a cathode 16, resonant system 21 of cavities, and the extension of radiating cavities on the horn antenna is shown by 26. For the extension of the noncoupled cavity with the antenna along the dotted line 60, their maximum radii in the antenna are still less than the cutoff radius for the radiating $TE_{01}$ mode.

When only two diametrically opposite cavities are extended onto the horn antenna as shown by 52 in FIG. 2C, the structure of electric fields exciting the antenna corresponds to radiation of the $TE_{11}$-mode. The horn antenna radiates this lowest mode of a cylindrical waveguide in the form of a narrow wave beam close to a Gaussian pattern, which is very attractive for many applications. The Gaussian wave beam can be formed by this method in the MDO when phases of the wave fields in diametrically opposite cavities are opposite, for example, the number of cavities is N=(2s+1)*2 where s is any positive integer including s=0. The symmetrical radiation pattern can be formed in the MDO with any even number of cavities.

The configuration of cavities and their extension onto a horn antenna can be different from the sectors indicated in FIG. 3. For example, a MDO with rectangular cavities and rectangular extension onto a horn antenna is contemplated. Additionally, these mode conversions are achieved without increasing the dimensions of the conical horn antenna, and may even allow for a decrease in the aperture when the azimuthal index of the radiating wave is less than N/2.

These mode converters can operate across a wide band of frequencies, because they are free of elements that are sensitive to the field frequency.

Figure 5A:
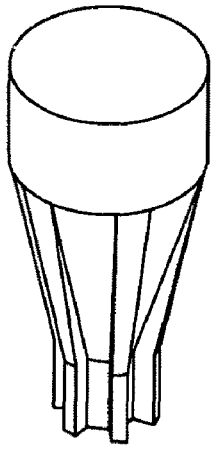
FIG. 5A is a perspective view of a resonant system with mode converters of the operating π-mode, to the radiated $TE_{31}$ mode corresponding to the design in FIG. 1*a* according to the present invention.
Figure 5B:
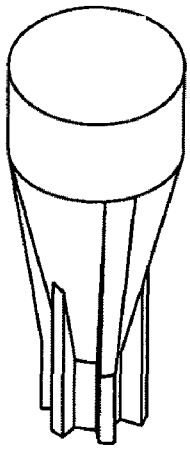
FIG. 5B is a perspective view of a resonant system with mode converters of the operating π-mode to the radiated $TE_{01}$ mode corresponding to the design in FIG. 1*a* according to the present invention.
Figure 5C:
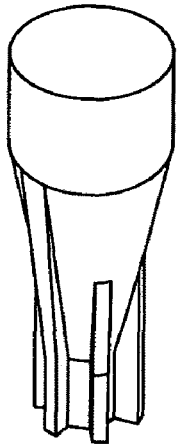
FIG. 5C is a perspective view of a resonant system with mode converters of the operating π-mode to the radiated $TE_{11}$ mode corresponding to the design in FIG. 1*a* according to the present invention.

FIG. 5A is a perspective view of a resonant system with mode converters of the operating π-mode to the radiated $TE_{31}$ mode. FIG. 5B is a perspective view of a resonant system with mode converters of the operating π-mode to the radiated $TE_{01}$ mode and FIG. 5C shows the operating π-mode to the radiated $TE_{11}$ mode.

To demonstrate the efficiency of this method of mode conversion, computer simulations of a MDO were used with the cathode radius of $R_c$,=1.58 cm, the axial length of the anode block being 7.2 cm consisting of 6 sector cavities with each cavity of a radial depth of 2 cm and a 20° angular opening to the interaction space. In order to exclude competition between the 2π-mode and π-mode, the phase velocities are separated, which are practically coincident with the anode radius $R_a$=2.11 cm by increasing the radius up to $R_a$=2.71 cm. Such an increase is acceptable in order to provide synchronous interaction of the electrons with the operating wave in the entire space between the electrodes. The space charge of the electrons promotes the condition in Equation (1) in the narrow gap between the electrodes when $R_a/R_c \leqq 2\sim2.5$). Table 1 illustrates the dimensions of horn antennas for conversion to different modes. For example, for the operating $TE_{31}$ mode with a wavelength λ=12.295 cm the radii R of the horn antennas with different number m of tapered cavity extensions correspond to the radiated $TE_{31}$ (m=6), $TE_{01}$ (m=3) and $TE_{11}$ (m=2) modes. In addition, the cutoff radii $R_{cutoff}$ corresponding to cutoff cross-sections for these modes and flare angles $\alpha$ (see FIG. 4) are listed. The length of the conical horn antenna for all mode converters was chosen to be identical at L=20 cm.

TABLE 1

Dimensions of horn antennas for conversion to different modes

| mode | m | $R_{cutoff}$, cm | R, cm | $\alpha°$ |
|---|---|---|---|---|
| $TE_{31}$ | 6 | 8.221 | 9.0 | 48.4 |
| $TE_{01}$ | 3 | 7.498 | 7.6 | 41.6 |
| $TE_{11}$ | 2 | 3.603 | 6.2 | 34.4 |

The choice of parameters for the antennas in Table 1 is guided by the objective of minimizing the dimensions to maintain compactness. Incomplete conversion of the operating $\pi$-mode to other modes is possible to a certain extent and some distortions of the calculated radiation patterns when compared with the ideal field distributions corresponding to radiation of "pure" waves are expected. In order to decrease these distortions, the flare angle $\alpha$ should be decreased thereby increasing the lengths of the converters, and increasing the ratio $R/R_{cutoff}$.

To estimate the efficiency of the mode converters with parameters indicated in Table 1, the HFSS code, which is interactive software that computes S- parameters and full-wave fields for arbitrarily-shaped 3D passive structures, was used. Field patterns for the far-field distribution $|E(\theta, \phi)|_\phi$as well as its polar $|E(\theta, \phi)|_\phi$azimuthal $|E(\theta, \phi)|_\phi$components, which relate to the maximum value of $|E(\theta, \phi)|_\phi$were calculated and plotted in FIG. 6, FIG. 7 and FIG. 8.

Figure 6A:
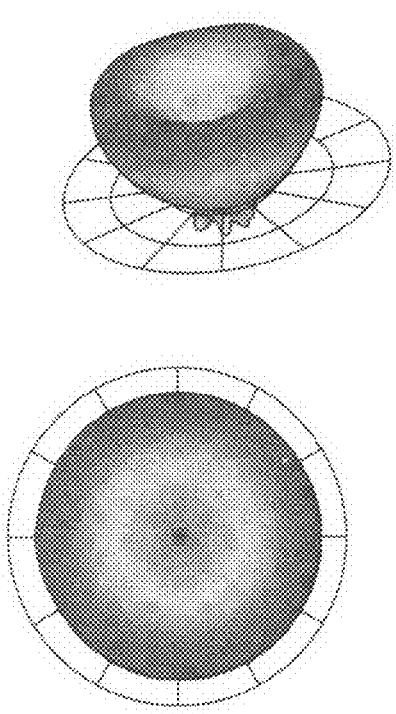
FIG. 6A illustrates the far total electric field distribution of the $TE_{31}$ mode when all 6 resonators are extended onto the horn antenna with according to the present invention.
Figure 6B:
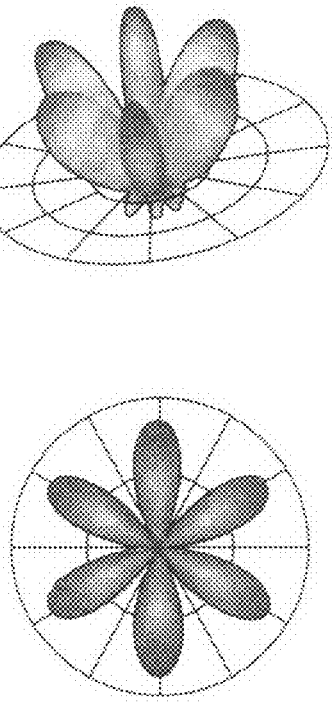
FIG. 6B illustrates the far azimuthal electric field distribution of the $TE_{31}$ mode when all 6 resonators are extended onto the horn antenna with according to the present invention.
Figure 6C:
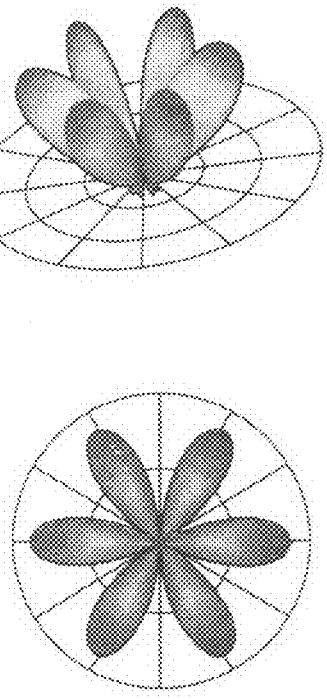
FIG. 6C illustrates the far polar electric field distribution of the $TE_{31}$ mode when all 6 resonators are extended onto the horn antenna with according to the present invention.
Figure 7A:
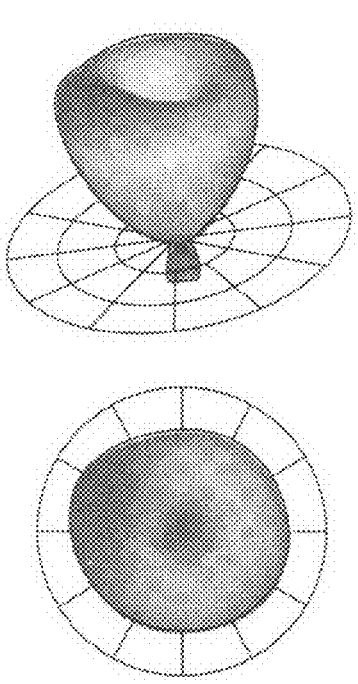
FIG. 7A illustrates the far total electric field distribution of the $TE_{01}$ mode when only three alternate resonators are extended onto the horn antenna according to the present invention.
Figure 7B:
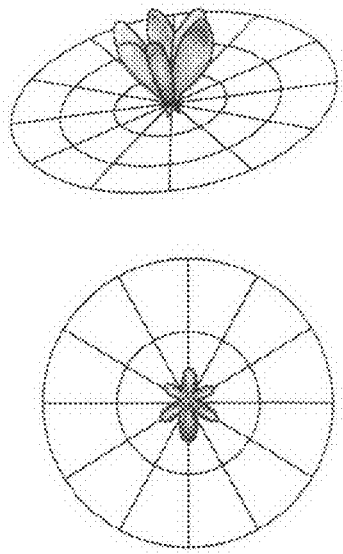
FIG. 7B illustrates the far azimuthal electric field distribution of the $TE_{01}$mode when only three alternate resonators are extended onto the horn antenna according to the present invention.
Figure 7C:
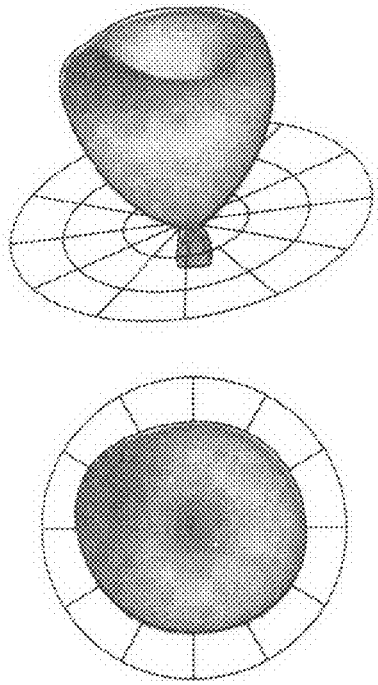
FIG. 7C illustrates the far polar electric field distribution of the $TE_{01}$ mode when only three alternate resonators are extended onto the horn antenna according to the present invention.
Figures 8A, 8B, 8C:
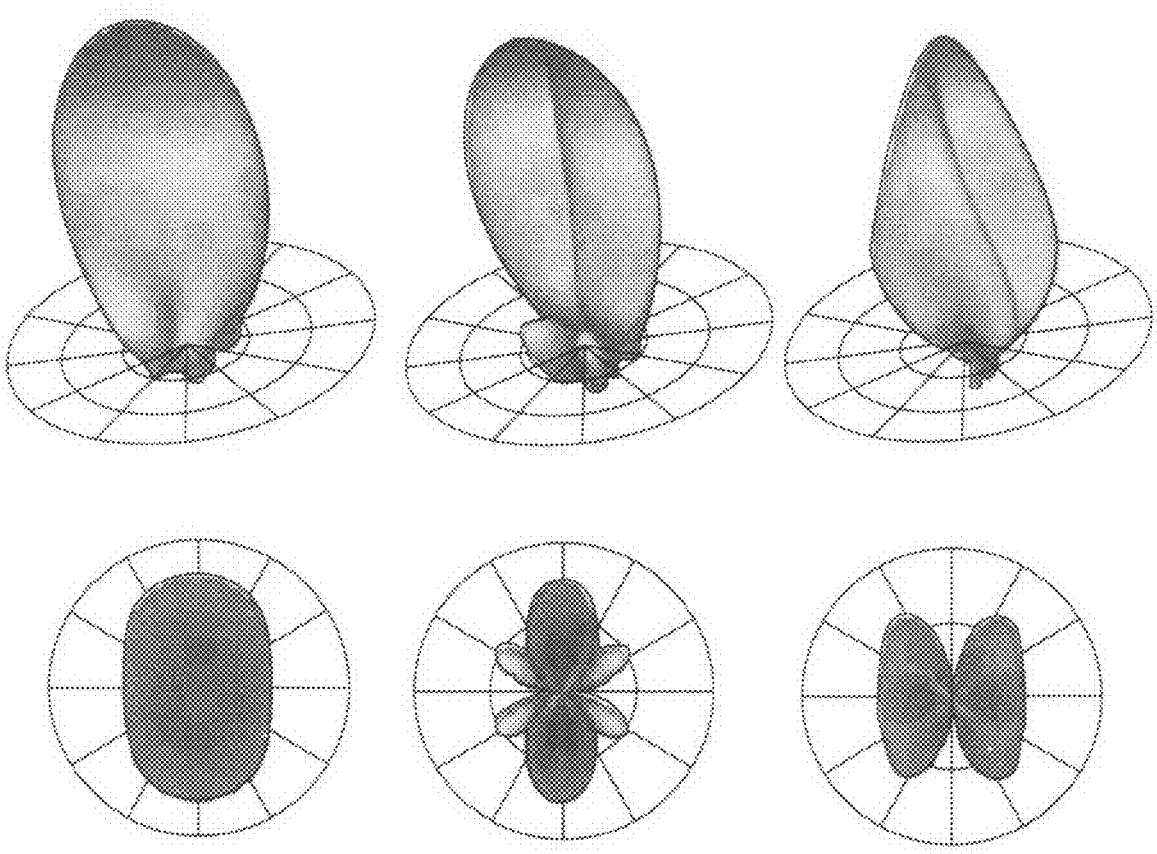
FIG. 8A illustrates the far field distribution of the $TE_{11}$ mode when only two opposite resonators are extended onto the horn antenna according to the present invention.
FIG. 8B illustrates the far azimuthal electric field distribution of the $TE_{11}$ mode when only two opposite resonators are extended onto the horn antenna according to the present invention.
FIG. 8C illustrates the far polar electric field distribution of the $TE_{11}$ mode when only two opposite resonators are extended onto the horn antenna according to the present invention.
Figure 9A:
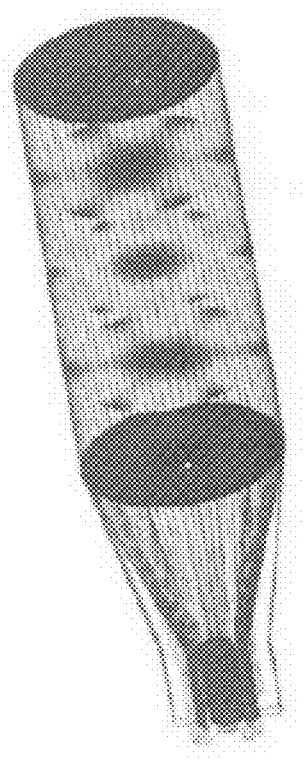
FIG. 9A illustrates distributions of the electric field of the $TE_{31}$ wave in the output waveguide for the design in FIG. 1*a* according to the present invention.
Figure 9C:
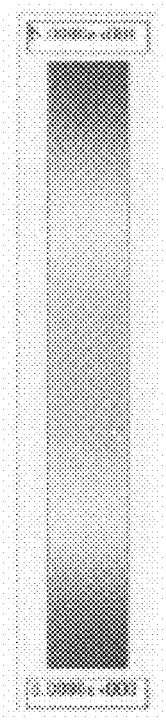
FIG. 9C illustrates the color scale of electric field amplitude for the distributions in FIG. 6A, FIG. 6B, FIG. 6C, FIG. 7A, FIG. 7B, FIG. 7C, FIG. 8A, FIG. 8B, FIG. 8C, FIG. 9A and FIG. 9B.

FIG. 6A, FIG. 6B and FIG. 6C illustrate the far field distribution of the $TE_{31}$ mode when all 6 resonators are tapered onto the horn antenna with $|E|$, $|E_\theta,|$, and $|E_\phi|$, respectively. FIG. 7A, FIG. 7B, and FIG. 7C illustrate the far field distribution of the $TE_{01}$ mode when only three alternate resonators are tapered onto the horn antenna with $|E|$, $|E_\theta,|$, and $|E_\phi|$, respectively. FIG. 8A, FIG. 8B, and FIG. 8C illustrates the far field distribution of the $TE_{11}$ mode when only two opposite resonators are tapered onto the horn antenna with $|E|$, $|E_\theta,|$, and $|E_\phi|$, respectively. FIG. 9C illustrates the color scale of electric field amplitude for the distributions in FIG. 6A, FIG. 6B, FIG. 6C, FIG. 7A, FIG. 7B, FIG. 7C, FIG. 8A, FIG. 8B and FIG. 8C.

In FIG. 6, FIG. 7 and FIG. 8, the colors show the distribution of field amplitudes with respect to maximum values. In the far region, where the distance l from the antenna aperture D is large, $l \gg D^2/\lambda$, the longitudinal component of the electric field vanishes. Angular distributions of radiated fields shown in FIG. 6, FIG. 7 and FIG. 8 show that impurity due to parasitic modes is insignificant in spite of the non-optimal choice of antenna dimensions. FIG. 9C illustrates the color scale of electric field amplitude.

Clearly, the purest radiation pattern corresponding to the radiated $TE_{31}$ mode is observed when all cavities are tapered onto the horn antenna and all the cavities are identically loaded shown in FIG. 6.

For the "$\pi$-mode—$TE_{01}$" converter, FIG. 7B shows the presence of the cross field (the polar $E_\theta$component) in the radiated $TE_{01}$ mode in the far-field region, which can be caused by partial field leakage from the closed cavities into the horn antenna. Comparing the polar electric filed component in FIG. 7B and the azimuthal electric field components in FIG. 7C, the estimated contribution of the polar component to the radiation power pattern is about 2%. Again, FIG. 9C illustrates the color scale of electric field amplitude.

Also, the contribution of the polar component shown in FIG. 8B of the radiation pattern of FIG. 8A is small as well due to a small penetration of the $\pi$-mode into the antenna in the "$\pi$-mode—$TE_{11}$" converter.

Thus, noticeable distortions in the observed radiation patterns do not necessarily indicate poor conversion. It is known that small impurities of parasitic modes may lead to significant redistribution of radiation power. However, these distortions do not play a crucial role in most applications since most of the contribution of the impurities goes onto forming side lobes, the divergence of which is larger than that of the main lobe.

Figure 9B:
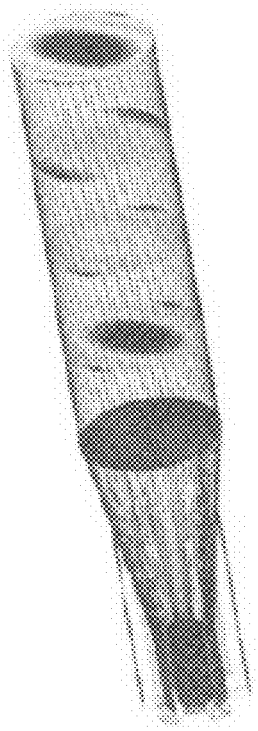
FIG. 9B illustrates distributions of the electric field of the $TE_{11}$ wave in the output waveguide for the design in FIG. 1*a* according to the present invention.

Moreover, the efficiency of the described method of mode conversion by observing the structure of the electric fields in the cylindrical output waveguide adjoining the horn antenna is demonstrated. FIG. 9A illustrates distributions of the electric field of converted waves in the output waveguide when all 6 cavities are extended into the horn antenna. FIG. 9B illustrates distributions of the electric field of converted waves in the output waveguide when only two opposite cavities are open. FIG. 9C illustrates distributions of the electric field of converted waves in the output waveguide as a graphical scale representing amplitude of the electric field, V/m, corresponding to the input electromagnetic power of 1.0 W.

As shown in FIG. 9, the field structures stand out conspicuously at a wavelength of $\lambda$=12.295 cm in the output waveguides after the horn antenna, when all the cavities are open (radiating the $TE_{31}$ mode) and when only two cavities are open (radiating the $TE_{11}$ mode). For the "$\pi$-mode—$TE_{11}$" converter, the cross section of the output waveguide for the radiated mode is chosen to be less than that of the higher order modes that provide excitation of pure modes in the output waveguide. Such an output waveguide, after the diffraction output, would therefore be useful as a filter to remove parasitic mode impurities.

Significant reflections of the operating $\pi$-mode of the magnetron from the interface with the antenna can occur when the antenna aperture dimension is close to the cutoff cross section for the radiated wave and/or the flare angle of the conical horn antenna is large. Furthermore, different combinations of closed and open cavities in different mode converters lead to azimuthal in homogeneities in the reflected fields. It was therefore necessary to assess how these reflections influence MDO operation.

Figure 10A:
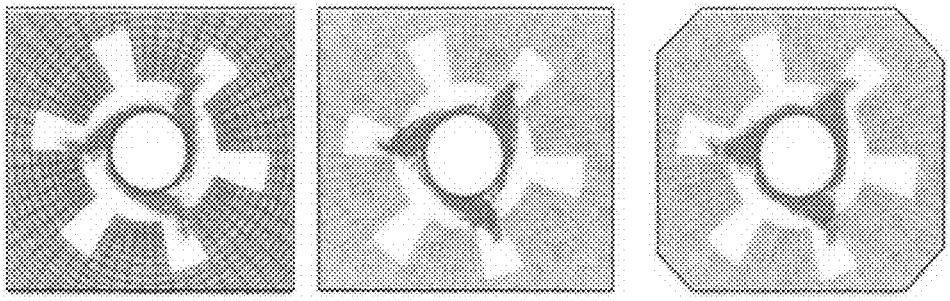
FIG. 10A illustrates an azimuthal particle plot of the electron flow inside the interaction space according to the present invention.

MAGIC simulations found that the MDO operates steadily in the $\pi$-mode in the region of applied voltage of U=700 kV for a fixed magnetic field of B=0.6 T in the interaction space for each of the mode converters listed in Table 1. For example, FIG. 10A shows that electron trajectories in the form of three electron spokes, which are typical for $\pi$-mode operation, are almost invariant in the magnetrons using different mode converters. FIG. 10A illustrates a particle plot of the electron flow inside the interaction space when all 6 cavities are open radiating the $TE_{31}$ mode, three alternate cavities are open radiating the $TE_{01}$ mode, and two opposite cavities open radiating the $TE_{11}$ mode. In FIG. 10 A, the applied voltage is 700 kV and the magnetic field is 0.6 T.

Figure 10B:
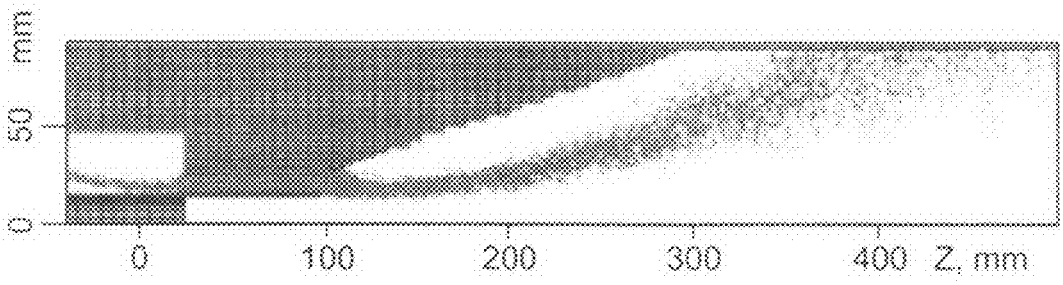
FIG. 10B illustrates a particle plot of the electron flow in the r-z plane for the design corresponding to FIG. 1*a* according to the present invention.

Also, electron trajectories on the r-z plane shown in FIG. 10B, are identical for these magnetrons. The trajectories are determined by the longitudinal distribution of the applied magnetic field.

Figure 11:
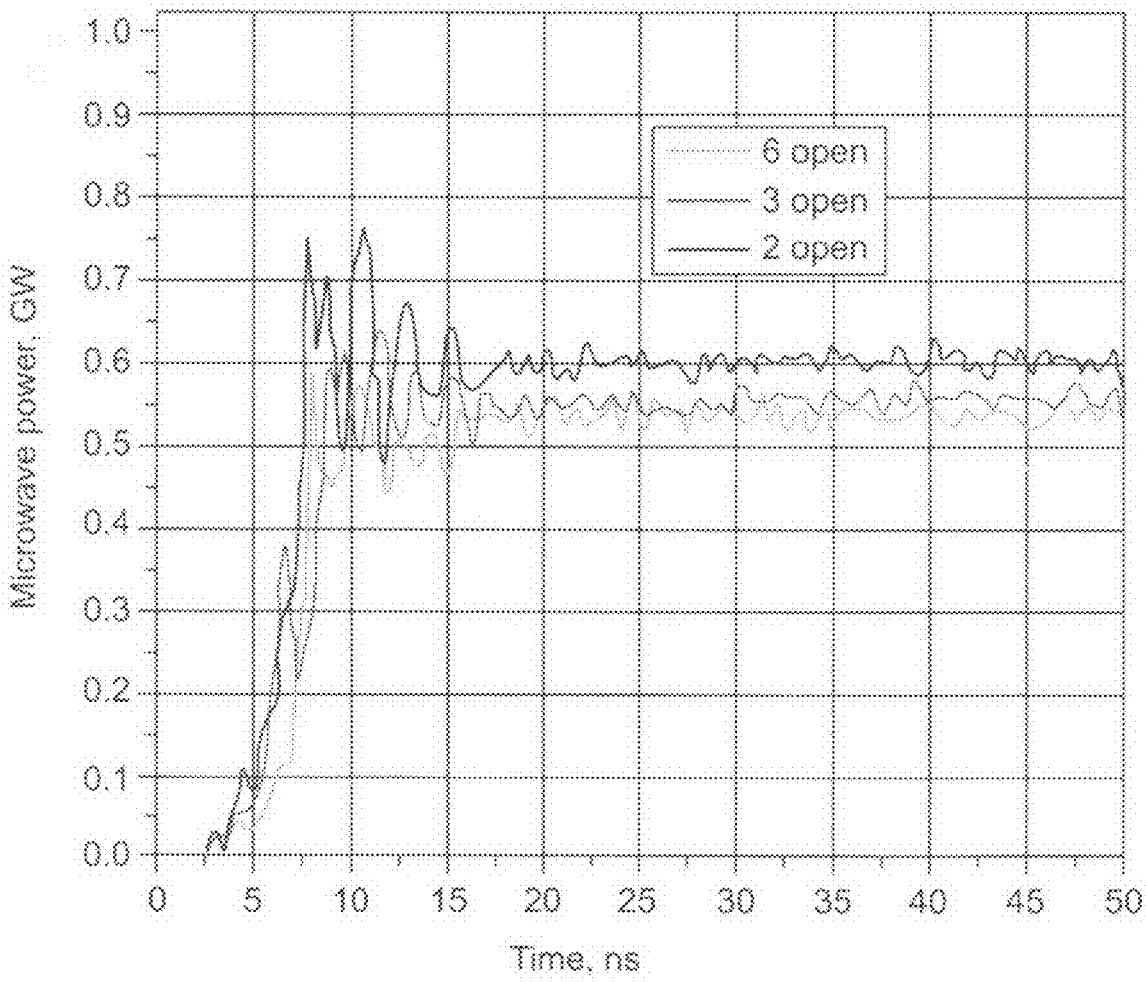
FIG. 11 shows a plot of the output microwave power vs. time for the magnetron operating in the π-mode with different mode converters according to the present invention.

FIG. 11 shows a plot of the output microwave power vs. time for the magnetron operating in the $\pi$-mode with different mode converters when the applied voltage is 700 kV with rise time 1 ns and magnetic field is 0.6 T. As shown in FIG. 11, the differences in the radiated power are similarly small. For all these cases, the anode current and the radiation frequency are essentially the same.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A relativistic magnetron with axial extraction, comprising:

a mode converter including a number of cavities defined by $N=2(2s+1)$ where s any positive integer, said cavities extend in an axial direction onto a diffraction output of radiation up to a diameter of an antenna that exceeds the diameter corresponding to a cutoff frequency of a radiated wave in a regular cylindrical waveguide, and said mode converter placed directly within said diffraction output of radiation effectively converts an operating $\pi$-mode into a radiated mode of a simpler radiation pattern across a wide band of frequencies and said cavities with the same polarization placed in each azimuthally identical half of the relativistic magnetron with mirror symmetry extend onto said diffraction output providing conversion of said operating $\pi$-mode to a $TE_{11}$-mode that is radiated with a radiation pattern approximate to a Gaussian radiation pattern with linear polarization that is parallel to an imaginary line that divides said azimuthally symmetric halves.

2. The relativistic magnetron of claim 1, wherein said diffraction output of radiation is a conical horn antenna.

3. The relativistic magnetron of claim 2, wherein all cavities of said mode converter extend onto said conical horn antenna thereby providing a radiation pattern corresponding to the operating wave.

4. The relativistic magnetron of claim 2, wherein every other cavity of said mode converter extends onto said conical horn antenna thereby providing a radiation pattern that corresponds to a symmetrical $TE_{01}$-mode.

5. The relativistic magnetron of claim 1, wherein said mode converter includes two diametrically opposite cavities that extend onto said diffraction output thereby providing a radiation pattern that is a narrow wave beam close to a Gaussian radiation pattern.

6. The relativistic magnetron of claim 1, wherein at least two diametrically opposite cavities are opened directly to an output waveguide to provide conversion of said operating $\pi$-mode to said $TE_{11}$-mode without said conical horn antenna.

7. The relativistic magnetron of claim 6, wherein a radius of said output waveguide is the same as a radius of an anode block comprising of a plurality of cavities that provide the minimal volume of a magnetic field-producing system.

8. The relativistic magnetron of claim 7, wherein said magnetic field-producing system is a solenoid placed around the relativistic magnetron.

* * * * *